US008205478B1

(12) United States Patent
Hallisey

(10) Patent No.: US 8,205,478 B1
(45) Date of Patent: Jun. 26, 2012

(54) SMOKE DETECTOR TESTING TOOL

(76) Inventor: Richard D. Hallisey, Malden, MA (US)

( * ) Notice: Subject to any disclaimer, the term of this patent is extended or adjusted under 35 U.S.C. 154(b) by 837 days.

(21) Appl. No.: 12/317,520

(22) Filed: Dec. 24, 2008

(51) Int. Cl.
*G08B 29/12* (2006.01)

(52) U.S. Cl. ..... 73/1.06; 340/515

(58) Field of Classification Search ..... 73/1.03, 73/1.05–1.06; 324/202; 340/514–515
See application file for complete search history.

(56) References Cited

U.S. PATENT DOCUMENTS

| | | | | | |
|---|---|---|---|---|---|
| 3,693,401 | A | * | 9/1972 | Purt et al. | 73/1.05 |
| 3,729,979 | A | * | 5/1973 | Wiberg et al. | 340/515 X |
| 4,271,693 | A | | 6/1981 | Bute | |
| 4,301,674 | A | | 11/1981 | Haines et al. | |
| 4,462,244 | A | * | 7/1984 | Lee | 73/1.05 |
| D275,183 | S | | 8/1984 | Minozzi, Jr. | |
| 5,076,966 | A | * | 12/1991 | Marone | 252/408.1 |
| 5,139,699 | A | * | 8/1992 | Cooper et al. | 73/1.05 X |
| 5,309,148 | A | | 5/1994 | Birk | |
| 5,361,623 | A | | 11/1994 | Wantz | |
| 5,670,946 | A | | 9/1997 | Ellwood et al. | |
| 6,198,399 | B1 | | 3/2001 | Mattis | |
| 6,875,373 | B2 | * | 4/2005 | Elendu | 252/408.1 |
| 2009/0308134 | A1 | * | 12/2009 | Pepper | 73/1.06 |

FOREIGN PATENT DOCUMENTS

WO WO 2006064190 A1 * 6/2006

* cited by examiner

*Primary Examiner* — Thomas P Noland
(74) *Attorney, Agent, or Firm* — Montgomery Patent & Design, LLC; Robert C. Montgomery; Joseph T. Yaksich

(57) ABSTRACT

An apparatus to aid in the testing of smoke detectors comprises a rifle-shaped design which holds and dispenses aerosol cans of smoke and air is herein disclosed. The apparatus is approximately four (4) feet long and includes additional extension tubes approximately three (3) feet long. In such a manner the apparatus is capable of reaching smoke detectors that are seven (7) feet or more above the users head. In addition to dispensing smoke for testing and air for purging, the apparatus also includes a magnetic adapter for testing smoke detector switches, a mechanical probe attachment for smoke detector activation, and a holder for electronic devices such as barcode scanners. In such a manner the testing and maintenance of most smoke detectors can be performed safely from ground level without the use of ladders or other assistance.

22 Claims, 4 Drawing Sheets

SMOKE DETECTOR TESTING TOOL

RELATED APPLICATIONS

The present invention was first described in a notarized Official Record of Invention on Apr. 3, 2008, that is on file at the offices of Montgomery Patent and Design, LLC, the entire disclosures of which are incorporated herein by reference.

FIELD OF THE INVENTION

The present invention relates generally to an apparatus to aid in the testing of smoke detectors and, more particularly, to said apparatus comprising a rifle-shaped design which holds and dispenses aerosol containers of smoke and air for enabling a user to position said containers close to test said smoke detectors.

BACKGROUND OF THE INVENTION

Perhaps the most important device present in a home to protect lives and property is the smoke alarm detector. These devices provide an excellent means of detecting the early stages of fire thus giving occupants adequate time to escape. However, for such devices to work effectively they must be tested. While just about all units provide a test button, the only sure way of testing such devices is with the use of real smoke. Testing products such as "smoke in a can" do exist but must be positioned close to the detector to operate properly. As most detectors are at an elevated location, ladders or other devices are often required to perform testing sequences. This additional complication leads to additional time and effort thus causing many to skip such testing. Other maintenance and testing functions performed at smoke detectors including cleaning, testing of magnetic adapters, access to bar codes, and the like also face the same difficulties. Accordingly, there exists a need for a means by which adequate testing and maintenance of smoke detectors can be performed without the disadvantages as listed above. The development of the invention described herein fulfills this need.

There have been attempts in the past to invent devices to test smoke detectors. U.S. Pat. No. 6,198,399 issued to Mattis discloses a smoke detector test device and method for manufacture that appears to comprise a plate that attaches to a handle utilizing flanges. Unfortunately, this patent does not appear to disclose a smoke detector testing device that comprises a smoke dispensing assembly and an air dispensing assembly to purge the smoke from the detectors, nor does this patent appear to disclose a mechanical or magnetic probe to test the detector's buttons and/or switches.

U.S. Pat. No. 5,670,946 issued to Ellwood et al. discloses a smoke detector sensitivity testing apparatus comprising a means to deliver aerosolized smoke and air to a detector. Unfortunately, this patent does not appear to disclose a smoke detector testing tool that comprises a magnetic or mechanical probe for testing switches and/or buttons on the detector, nor does it appear to disclose a smoke detector testing tool that through a plurality of extension tubes is capable testing smoke detectors mounted high on walls.

U.S. Pat. No. 5,361,623 issued to Wantz discloses a delivery system for a smoke detector testing spray formulation. Unfortunately, this patent does not appear to disclose a smoke detector testing device that comprises a smoke dispensing assembly and an air dispensing assembly to purge the smoke from the detector, nor does this patent appear to disclose a mechanical or magnetic probe to test the detector's buttons and/or switches.

U.S. Pat. No. 5,309,148 issued to Birk discloses an apparatus and method for testing smoke detector operation that appears to comprise an aerosolized combination of latex particulates that are introduced into a smoke detector. Unfortunately, this patent does not appear to disclose a smoke detector testing tool that comprises a magnetic or mechanical probe for testing switches and/or buttons on the detector, nor does it appear to disclose a smoke detector testing tool that through a plurality of extension tubes is capable testing smoke detectors mounted high on walls.

U.S. Pat. No. D 275,183 issued to Minozzi discloses a smoke detector tester that appears to comprise a tester that apparently utilizes smoke from a cigarette to test a smoke detector. Unfortunately, this design patent does not appear to be similar in appearance to the disclosed apparatus, nor does it appear to possess a smoke dispensing assembly that utilizes a can of smoke for detector testing.

U.S. Pat. No. 4,301,674 issued to Haines et al discloses a smoke detector tester that appears to be an aerosol can contain particulates that simulate the early stages of a combustion fire. Unfortunately, this patent, likewise, does not appear to disclose a smoke detector testing tool that comprises a magnetic or mechanical probe for testing switches and/or buttons on the detector, nor does it appear to disclose a smoke detector testing tool that through a plurality of extension tubes is capable testing smoke detectors mounted high on walls.

U.S. Pat. No. 4,271,693 issued to Bute discloses a telescoping device that comprises an electrical mechanism to trigger smoke for testing smoke detector alarms. Unfortunately, this patent does not appear to disclose a smoke detector testing device that comprises a smoke dispensing assembly and an air dispensing assembly to purge the smoke from the detector, nor does this patent appear to disclose a mechanical or magnetic probe to test the detector's buttons and/or switches.

None of the prior art particularly describes an apparatus to aid in the testing of smoke detectors comprising a rifle-shaped design which holds and dispenses aerosol containers of smoke and air that the instant apparatus possesses. Accordingly, there exists a need for a means by which adequate testing and maintenance of smoke detectors can be performed that operates without the disadvantages as described above.

SUMMARY OF THE INVENTION

In light of the disadvantages, as previously discussed in the prior art, it is apparent that there is a need for a smoke detector testing tool which provides a rifle-shaped design which holds and dispenses gas products including a smoke container and an air container for the purpose of testing a wide variety of smoke detectors.

It is an object of the smoke detector testing tool to dispense smoke to test a smoke detector and to also release air on demand to clean a smoke detector.

Another object of the smoke detector testing tool provides magnet and probe adaptors to test switches and buttons located on a smoke detector.

A further object of the smoke detector testing tool possesses handle-like appendages with which permits an operator to securely hold the tool in a steady manner utilizing both hands.

Still another object of the smoke detector testing tool is made of polyvinylchloride (PVC) or another non-electrically conductive material.

Still a further object of smoke detector testing tool possesses an air supply to permit an operator to purge a previously dispensed volume of smoke gas remaining within a smoke detector during a test.

Yet another object of the smoke detector testing tool possesses attachments such as a test enclosure to isolate a volume of smoke to a ceiling-mounted detector, a magnetic probe for testing reed-type smoke detector switches, a mechanical probe for activating button-switched smoke detectors, and a wireless device holder for use with electronic devices such as barcode scanners and the like.

Yet a further object of the smoke detector testing tool comprises a telescoping conveying tube and additional extension tubes capable of reaching smoke detectors that are mounted to high ceilings which permit testing and maintenance of commercial and household smoke detectors from a floor level.

Still yet another object of the smoke detector testing tool provides for many configurations by adjusting the extended length of the conveying tube and attaching one (1) or more extension tubes.

Still a further object of the smoke detector testing tool provides a spring that aids in removal and replacement of a spent smoke container or spent air container.

An aspect of the smoke detector testing tool comprises a first gas tube comprising a plastic tubular structure that provides a telescoping attachment means to an inserted second gas tube. The second gas tube provides a length extending means thereto the apparatus comprising a round tubular portion. The first gas tube further comprises an adjustment knob threadingly engaged through said first gas tube wall that secures said second gas tube at a desired length.

Still another aspect of the smoke detector testing tool comprises a smoke dispenser assembly comprising a mounting and dispensing means to a purchased aerosol can of smoke gas. The smoke dispensing assembly further comprises a smoke dispenser handle, a first container fixture, a handgrip, a trigger, and an actuator.

Still a further aspect of the smoke detector testing tool comprises an air dispenser assembly that provides a mounting means to a base portion of a purchased aerosol air container. The air dispenser assembly further comprises a handgrip, an air dispenser handle, and a second container fixture. The air dispenser handle is affixed to the first gas tube.

Yet another aspect of the smoke detector testing tool comprises a plurality of attachments including a test enclosure assembly, a wireless device enclosure assembly, a magnetic probe assembly, and a mechanical probe assembly.

Yet a further aspect of the smoke detector testing tool comprises a smoke dispenser assembly providing a means to dispense a smoke gas flow from the smoke container into the first gas tube using a trigger-type actuator mechanism. A dispenser handle is affixed to the first gas tube and provides an attachment means to the first container fixture which comprises an inner diameter specifically suitable to a standard purchased smoke gas container.

A further aspect of the smoke detector testing tool comprises a test enclosure comprising a round bowl-shaped structure and further comprising an integral rim-mounted rectangular vent panel and an attached first angle adapter. The vent panel comprises an aperture with a section of screen material affixed thereto. The vent panel provides an evacuation means to an ambient gas volume upon introduction of the smoke gas flow into the enclosure body. The first angle adapter provides a removable attachment means to the second gas tube or extension tubes via a common male/female tubular feature.

Still another aspect of the smoke detector testing tool comprises a test enclosure assembly that provides a means to test a standard photoelectric or ionization type smoke detector mounted to an elevated ceiling; however, it is understood that additional smoke detector types having a similar shape may be tested equally well.

Still a further aspect of the smoke detector testing tool comprises a wireless device enclosure assembly comprising a holder body, a second angle adapter, and a label compartment. The holder body possesses an integral second angle adapter and provides an open-topped device having a generally rectangular top opening and internal space sized so as to easily admit said wireless devices. The label compartment comprises a cup shaped protrusion from a side surface of the holder body and sized so as to contain a roll of common barcode label stock.

Yet another aspect of the smoke detector testing tool comprises a magnetic probe assembly comprising a small cylinder-shaped magnet permanently affixed to a magnetic probe adapter. The magnetic probe assembly provides a testing means to magnetic and/or reed-type smoke detector switches.

Yet a further aspect of the smoke detector testing tool comprises a mechanical probe assembly comprises a mechanical probe portion and a probe adapter that form a one-piece plastic molded part. The mechanical probe assembly provides a mechanical activation means to a smoke detector with a button-type activation switch.

Still another aspect of the smoke detector testing tool comprises a rectangular sheet metal utility box attachment case comprising a case body, a plurality of attachment cavities, internal fill/padding, a case handle, a case hasp, a pair of hinges and a shallow top lid.

Still a further aspect of the smoke detector testing tool comprises a case lid comprising particular inner rectangular dimensions so as to fit snuggly over a mating perimeter edge of the case body. The case body and case lid further comprise conventional expected features such as a grasping case handle, a latching case lid hasp, and a pair of common metal axle hinges. Said case body and case lid provide protection to included attachments via an internal fill/padding portion comprising a specific profile and depth so as to emulate particular attachments and providing a snug padded fit.

A method of assembling the smoke detector testing tool may be achieved by performing the following steps: procuring an apparatus, a correct number of extension tubes, and appropriate attachments based upon anticipated smoke detector testing tasks and ceiling heights which may be encountered; loading an aerosol smoke container into the first container fixture; adjusting the vertical position of the aerosol smoke container in the first container fixture by adjusting the threaded actuator up or down to produce the desired smoke gas flow through the first gas tube; loading an aerosol air container into the second container fixture; carefully positioning the nozzle portion of the aerosol air container into the first gas tube orifice; removing an application-specific attachment, if required, from the attachment case, based upon a particular smoke detector testing task, installing said attachment by insertion of the second gas tube into.

A method of utilizing the smoke detector testing tool to test a variety of smoke detectors may be achieved by performing the following steps: testing a smoke detector device by loosening the adjustment knob portion of the first gas tube; extending said second gas tube outwardly to a needed length; tightening the adjustment knob, securing the second gas tube in position; adding a desired number of extension tubes by inserting a tubular end portion in the straight female adapter, as required by a particular detector testing task; manually pressing the trigger portion of the smoke dispenser assembly to propel a smoke gas flow from the aerosol smoke container through the first and second gas tubes and any attached extension tubes; engulfing said smoke detector in a smoke gas flow causing activation of the detector; restoring the smoke detector by subsequently pressing a valve portion of the aerosol air container, propelling an air gas flow through the apparatus, thereby purging smoke from the smoke detector to deactivate and complete the test; removing a spent smoke container by pressing down on the spring portion thereby angular release of the smoke container nozzle from the first gas tube and subsequently from the first container fixture.

A method of utilizing the test enclosure assembly portion of the smoke detector testing tool may be achieved by performing the following steps: removing the test enclosure assembly portion from the attachment case; adding a required number of extension tubes, as required to reach a detector by pressing the straight female adapter portion over the distal end portion of the second gas tube; adjusting the second gas tube length as needed to achieve a correct total length of the apparatus required to reaching a target smoke detector; mounting the test enclosure assembly to the apparatus by pressing the first angle adapter portion onto the distal end portion of the extension tube via a friction fit thereupon; raising the apparatus upwardly toward a ceiling or wall surface by holding the two (2) handgrips with each hand; positioning the enclosure body portion of the test enclosure assembly over said smoke detector so as to encapsulate said detector; sequentially applying the smoke and air gas flows to the detector as previously described to conduct a test; returning the test enclosure assembly portion to the attachment case when finished with said testing task.

A method of utilizing the remaining attachments of the apparatus to test a smoke detector may be achieved by performing the following steps: attaching the wireless device holder assembly to the extension tube portion in a similar manner as the aforementioned test enclosure assembly; performing necessary wireless related tests and data logging using various devices such as barcode scanners and the like; removing barcode labels as needed from the label compartment portion as needed; or attaching the magnetic probe assembly to the extension tube portion as previously described; performing various tests on magnetic switch portions of a smoke detector using the magnet; or attaching the mechanical probe assembly to said extension tube in like manner; activating one (1) or more button-activated smoke detectors as required, by contacting said switch button portion of the smoke detector using the probe.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
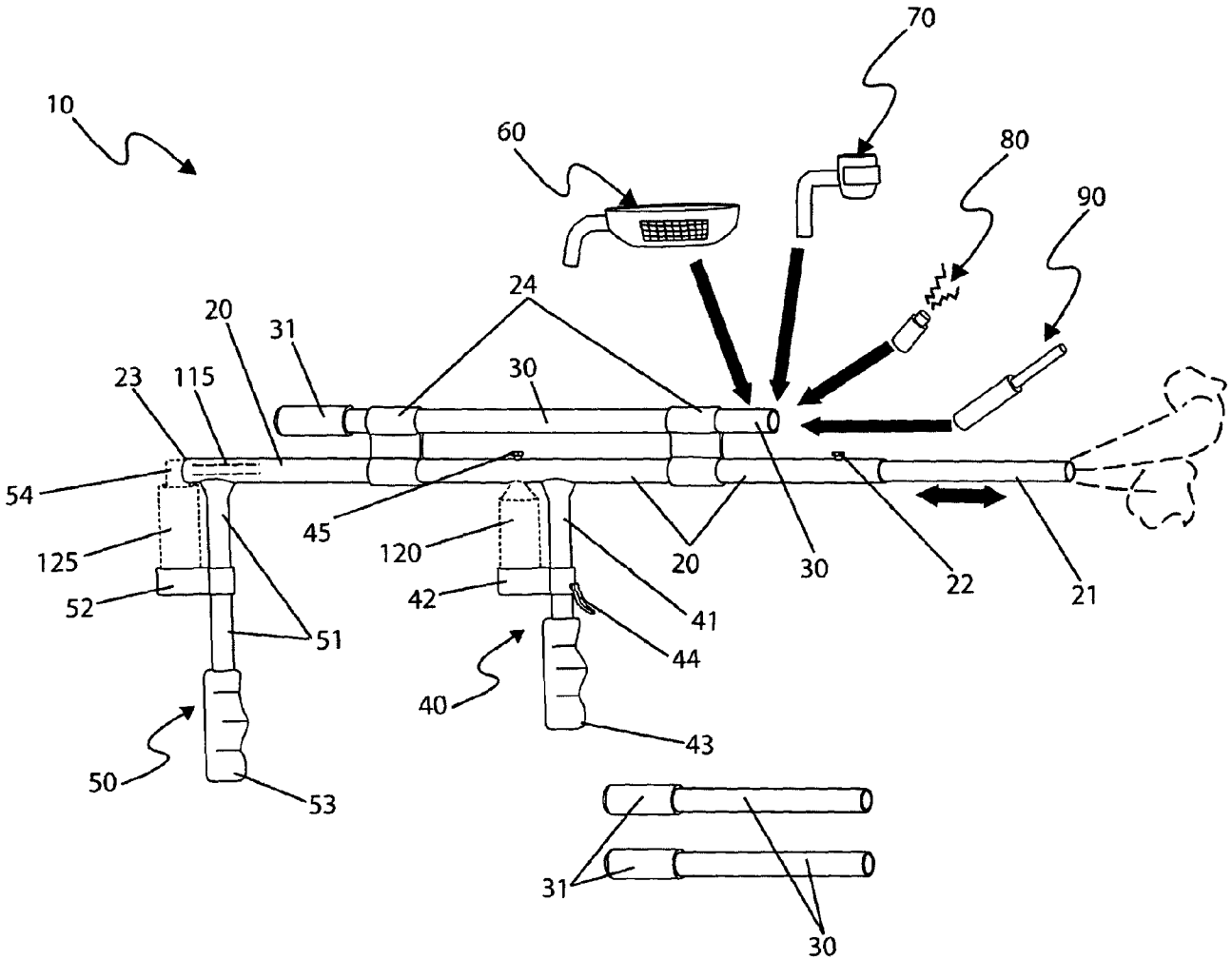
FIG. 1 is a side perspective view of a smoke detector testing tool 10, according to a preferred embodiment of the present invention.

| DESCRIPTIVE KEY | |
|---|---|
| 10 | smoke detector testing tool |
| 20 | first gas tube |
| 21 | second gas tube |
| 22 | adjustment knob |
| 23 | first gas tube orifice |
| 24 | clamp bracket |
| 25 | smoke container aperture |
| 30 | extension tube |
| 31 | straight female adapter |
| 40 | smoke dispenser assembly |
| 41 | smoke dispenser handle |
| 42 | smoke container fixture |
| 43 | smoke handgrip |
| 44 | smoke trigger |
| 45 | actuator |
| 46 | lever |
| 47 | pivot |
| 48 | spring |
| 50 | air dispenser assembly |
| 51 | air dispenser handle |
| 52 | air container fixture |
| 53 | air handgrip |
| 54 | air trigger |
| 60 | test enclosure assembly |
| 61 | enclosure body |
| 62 | vent |
| 63 | first angle adapter |
| 70 | wireless device holder assembly |
| 71 | holder body |
| 72 | second angle adapter |
| 73 | label compartment |
| 80 | magnetic probe assembly |
| 81 | magnet |
| 82 | magnetic probe adapter |
| 90 | mechanical probe assembly |
| 91 | probe |
| 92 | probe adapter |
| 110 | smoke gas flow |
| 115 | air gas flow |
| 120 | smoke container |
| 125 | air container |
| 130 | smoke detector |
| 140 | attachment case |
| 141 | case body |
| 142 | attachment cavity |
| 143 | fill/padding |
| 144 | case handle |
| 145 | case hasp |
| 146 | hinge |
| 147 | lid |
| 150 | wireless device |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a smoke detector testing tool (herein described as the "apparatus") 10, which provides a rifle-shaped design which holds and dispenses gas products including an aerosol smoke container 120 and an aerosol air container 125 for the purpose of testing a wide variety of smoke detectors 130. The apparatus 10 is approximately four (4) feet long and comprises a telescoping gas conveying tube 21 and additional extension tubes 30. In such a manner the apparatus 10 is capable of reaching smoke detectors 130 that are mounted thereto high ceilings. In addition to dispensing smoke 110 for testing and air 115 for purging, the apparatus 10 also includes attachments such as a test enclosure 60 to isolate a volume of smoke thereto a ceiling mounted detector 130, a magnetic probe 80 for testing reed-type smoke detector switches, a mechanical probe 90 for activating button-switched smoke detectors 130, and a wireless device holder 70 for use with electronic devices such as barcode scanners and the like. In such a manner, testing and maintenance of most commercial and household smoke detectors 130 may be accomplished therefrom a floor level.

Referring now to FIG. 1, a side perspective view of the apparatus 10, according to the preferred embodiment of the present invention, is disclosed. The apparatus 10 comprises a first gas tube 20 comprising a plastic tubular structure approximately four (4) feet long having an inner diameter of approximately one (1) inch and is envisioned being-made of polyvinylchloride (PVC) or other non-electrically conductive material. The first gas tube 20 provides a telescoping attachment means thereto an inserted second gas tube 21 at a distal end thereof. The second gas tube 21 provides a length extending means thereto the apparatus 10 comprising a round tubular portion approximately three (3) feet long and approximately three-quarters (¾) of an inch in diameter; thereby extending a vertical reaching range of the apparatus 10 thereto approximately seven (7) feet. The first gas tube 20 further comprises an adjustment knob 22 being threadingly engaged therethrough said first gas tube wall 20, thereby applying a clamping force to secure said second gas tube 21 thereat a desired length. The first gas tube 20 also provides an attachment means thereto a smoke dispenser assembly 40 and an air dispenser assembly 50 attached thereto a bottom surface using plastic molding or adhesive joining methods. The smoke dispenser assembly 40 and air dispenser assembly 50 extend perpendicularly therefrom a proximal end of the first gas tube 20 in a parallel fashion being arranged approximately sixteen (16) inches apart. The smoke dispenser assembly 40 and the air dispenser assembly 50 form handle-like appendages with which an operator may securely hold the apparatus 10 in a steady manner using both hands. The smoke dispenser assembly 40 provides a mounting and dispensing means thereto a purchased aerosol can of smoke gas 120. The smoke dispensing assembly 40 further comprises a smoke dispenser handle 41, a smoke container fixture 42, a handgrip 43, a trigger 44, and an actuator 45 (see FIG. 3 for additional detailed description). The air dispenser assembly 50 in like manner, provides a mounting means thereto a base portion of a purchased aerosol air container 125. The air dispenser assembly 50 further comprises a handgrip 43, an air dispenser handle 51, an air handgrip 53, an air trigger 54, and an air container fixture 52. In use, the air dispenser assembly 50 allows an operator to activate a can of air 125 in a normal manner to purge the detector 130 via the air trigger 54. The air gas flow 115 enters the first gas tube 20 via a first gas tube orifice portion 23 located at a proximal end of said first gas tube 20. Said air gas flow 115 provides a purging means thereto a previously dispensed volume of smoke gas 110 remaining therewithin a smoke detector 130 during a test. The air dispenser handle 51 is affixed thereto the first gas tube 20 as previously described and is envisioned to be made using similar materials as the first gas tube 20. The air container fixture 52 comprises an open-top cup-shaped cylindrical vessel having a depth and inner diameter suitable to providing sliding insertion of a base portion of a standard purchased aerosol air container 125 so as to position a nozzle portion of said air can 125 thereinto the aforementioned first gas tube orifice 23. The first gas tube 20 also provides attachment thereto a top-mounted removably attachable extension tube 30 mounted in a parallel manner thereto along an upper surface of said first gas tube 20 via a pair of clamp brackets 24. Said clamp brackets 24 comprise molded plastic fixtures comprising an integrally molded round aperture feature so as to facilitate insertion of the first gas tube 20 therethrough and being secured in place using common adhesives. The upper portion of the clamp bracket 24 further provides a flexible open top two-prong clamp similar thereto a common broom clamping device and having a cylindrical inner profile so as to retain the aforementioned round extension tube 30 therein. An additional two (2) extension tubes 30 are illustrated in a detached state here; however, it is understood that any number of extension tubes 30 may be purchased with the apparatus 10 based upon anticipated testing tasks and ceiling heights. Each extension tube 30 comprises approximately a three (3) foot length of circular plastic conduit having a straight female adapter 31 affixed thereto an end portion thereof. The straight female adapter 31 provides attachment thereto the second gas tube 21 as well as other extension tubes 30 via common mating of insertable inner and outer diameters resulting in a secure friction fit therebetween. The apparatus 10 further comprises a plurality of attachments including a test enclosure assembly 60, a wireless device enclosure assembly 70, a magnetic probe assembly 80, and a mechanical probe assembly 90, each of which is required to test particular types of detectors 130 and detector switches (see FIG. 4).

Figure 2:
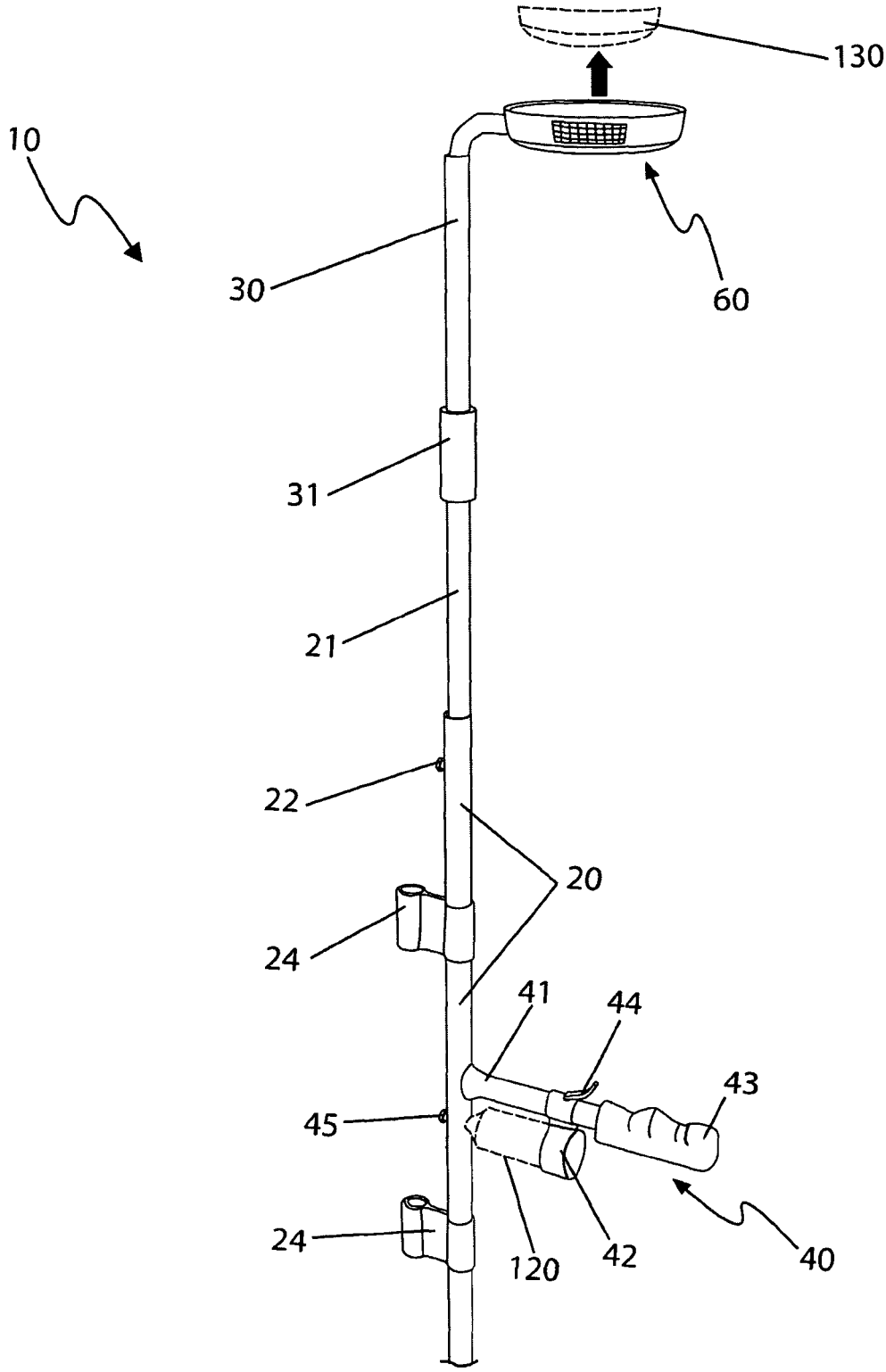
FIG. 2 is a perspective view of a smoke detector testing tool 10 depicting an in-use state, according to a preferred embodiment of the present invention.

Referring now to FIG. 2, a perspective view of the apparatus 10 depicting an in-use state, according to the preferred embodiment of the present invention, is disclosed. The apparatus 10 is depicted here having a particular configuration especially suited for testing standard photoelectric or ionization type ceiling mounted smoke detectors 130 being affixed thereto an elevated ceiling without use of a ladder, thereby saving time while conducting a test. The apparatus 10 comprises an assembly made up of the first gas tube 20, the second gas tube 21, a single extension tube 30, and a test enclosure assembly 60 (see FIG. 4). It is understood that many configurations may be possible resulting in widely varying overall length of the apparatus 10 by adjusting the extended length of the second gas tube 21 and by attaching one (1) or more extension tubes 30.

Figure 3:
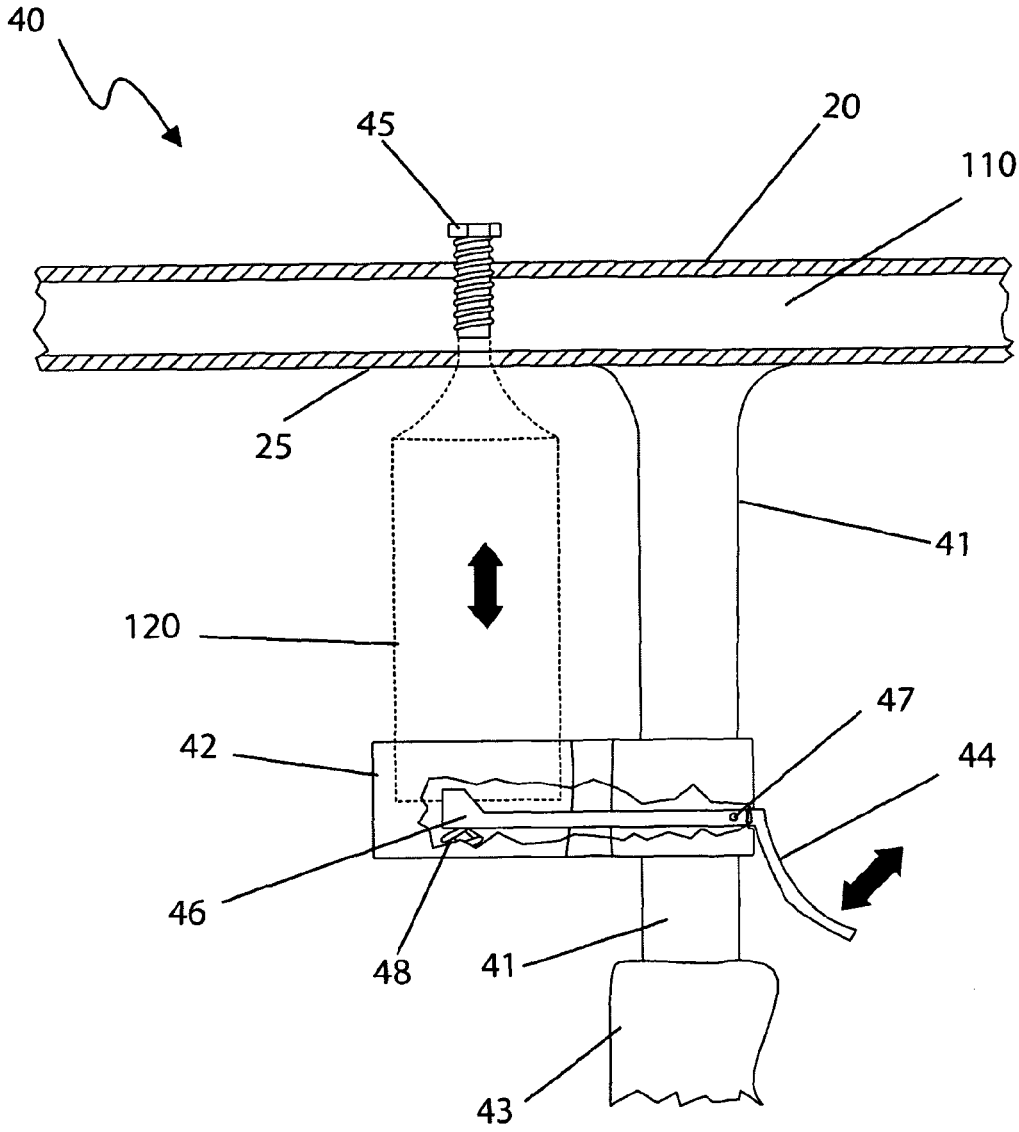
FIG. 3 is a close-up view of a smoke dispenser assembly portion 40, according to a preferred embodiment of the present invention; and, FIG. 4 is a perspective view of an attachment kit portion 140, according to a preferred embodiment of the present invention.

Referring now to FIG. 3, a close-up view of the smoke dispenser assembly portion 40 of the apparatus 10, according to a preferred embodiment of the present invention, is disclosed. The smoke dispenser assembly 40 provides a means to dispense a smoke gas flow 110 therefrom the smoke container 120 thereinto the first gas tube 20 using a trigger-type actuator mechanism 44. The smoke dispenser assembly 40 comprises a smoke dispenser handle 41, a smoke container fixture 42, a handgrip 43, a trigger 44, an actuator 45, a lever arm 46, a pivot 47, and a spring 48. The dispenser handle 41 is envisioned to be similar to the aforementioned air dispenser handle 51 being permanently affixed thereto the first gas tube 20. The smoke dispenser handle 41 provides an attachment means thereto the smoke container fixture 42 along an upper portion. The smoke container fixture 42 is envisioned being similar thereto the aforementioned air container fixture 52; however, said smoke container fixture 42 comprises an inner diameter specifically suitable thereto a standard purchased smoke gas container 120. The smoke container fixture 42 further allows single finger activation by an operator via the trigger 44 and integral lever portion 46. The trigger 44 and lever 46 form a one-piece stamped or machined metal device providing a pivoting motion about a stationary pivot pin 47 located discreetly therewithin a base portion of the smoke container fixture 42 as illustrated in a break-away portion of FIG. 3. The lever 46 in-turn provides a vertical motion which acts to lift the smoke container 120 thereagainst an actuator 45 causing subsequent contact and depression of a nozzle portion of said smoke container 120. The first gas tube 20 comprises a circular smoke container aperture 25 and an actuator 45 which work in conjunction therewith the smoke dispenser assembly 40. Said smoke container aperture 25 and actuator 45 portions are positioned along lower and upper surfaces of the first gas tube 20, respectively, being centered and superjacent thereto the smoke container fixture 42. In such a manner, the nozzle portion of the smoke container 120 protrudes upwardly therethrough the smoke container aperture 25, thereby contacting a lower end portion of the actuator 45 therewithin an inner space of the first gas tube 20. The actuator 45 comprises a common threaded fastener such as a bolt, being threadingly engaged therethrough an upper wall thickness portion of the first gas tube 20. Said actuator 45 provides a means to adjust a gap height therebetween the nozzle portion of the smoke container 120 and said actuator 45. Upon pressing of the trigger 44, the smoke container 120 is lifted, causing the nozzle portion of the smoke container 120 to contact the actuator 45, thereby propelling the smoke gas flow 110 therewithin the first gas tube 20. Additionally, a fixed-length compression spring 48 is located between the smoke container 120 and the lever 46 to position the smoke container nozzle 120 thereagainst the actuator 45. The spring 48 also aids in removal and replacement of a spent smoke container 120 by allowing a user to press downwardly and remove the smoke container 120.

Figure 4:
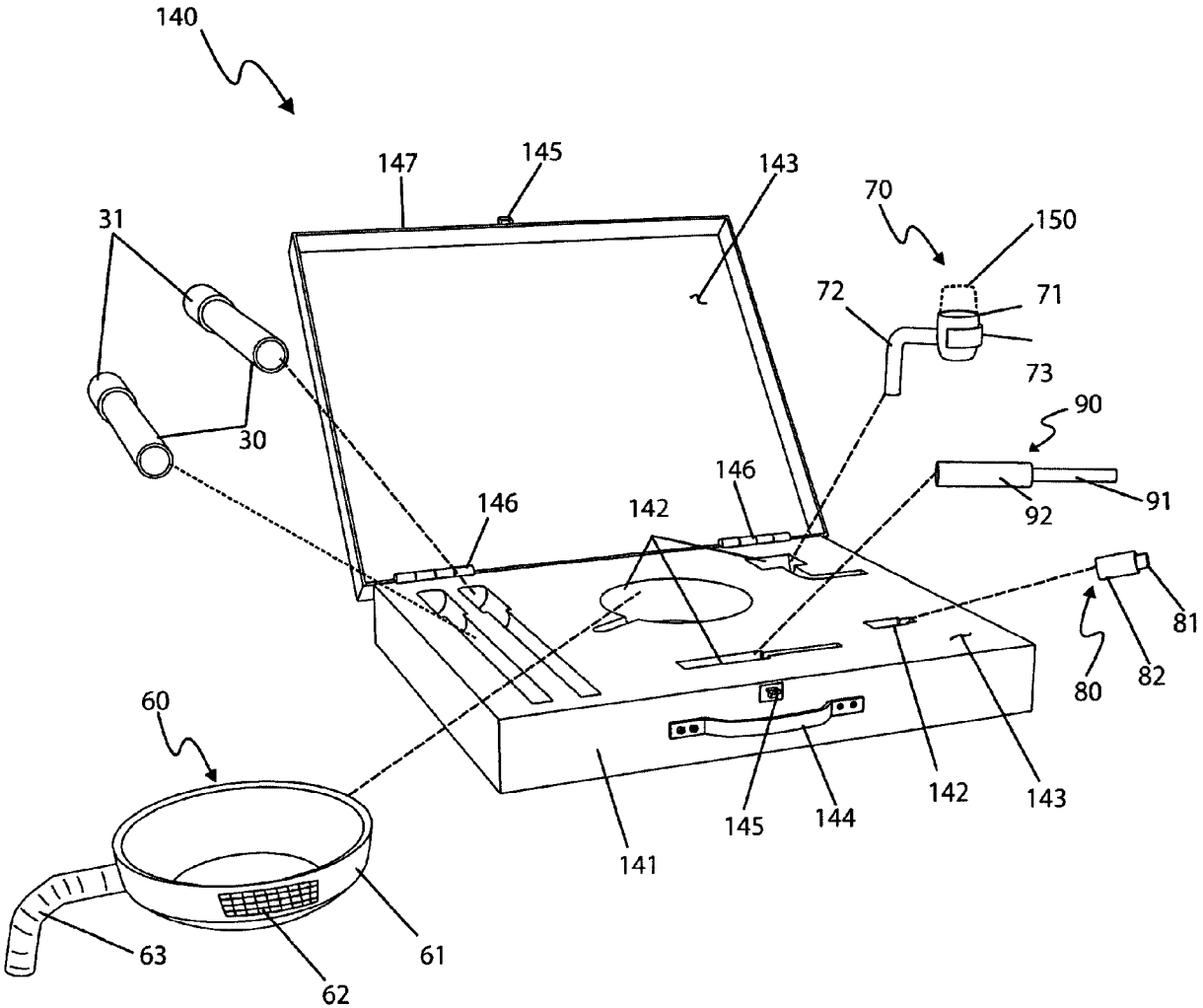

Referring now to FIG. 4, a perspective view of an attachment kit portion 140 of the apparatus 10, according to a preferred embodiment of the present invention, is disclosed. The apparatus 10 comprises a plurality of application-specific attachments in a kit form comprising a test enclosure assembly 60, a wireless device enclosure assembly 70, a magnetic probe assembly 80, a mechanical probe assembly 90, and an attachment case 140. The test enclosure assembly 60 provides a means to apply an isolating vessel thereto a ceiling or wall-mounted smoke detector 130, thereby enabling an operator to conserve a volume of dispensed smoke gas flow 110 during a test. The test enclosure 60 comprises a round bowl-shaped structure approximately twelve (12) inches in diameter and four (4) inches deep made of molded plastic materials and further comprising an integral rim-mounted rectangular vent panel 62 and an attached first angle adapter 63. The vent panel 62 comprises an aperture and a section of screen material affixed thereto being approximately four (4) inches wide by one (1) inch high. The vent panel 62 provides an evacuation means thereto an ambient gas volume upon introduction of the smoke gas flow 110 being communicated thereinto the enclosure body 61 via the first angle adapter 63. The first angle adapter 63 provides a hollow female plumbing conduit function similar thereto the aforementioned straight female adapter 31 by providing a removable attachment means thereto the second gas tube 21 or extension tubes 30 via a common male/female tubular feature. The test enclosure assembly 60 provides a means to test a standard photoelectric or ionization type smoke detector 130 being mounted thereto an elevated ceiling; however, it is understood that additional smoke detector types 130 having a similar round shape capable of being inserted therein the enclosure body 61 may be tested equally well. The wireless device enclosure assembly 70 provides a holster-type enclosure for insertion of a variety of wireless devices 150 envisioned to be electronic equipment such as, but not limited to: barcode scanners, other electronic devices, or the like. The wireless device enclosure assembly 70 comprises a holder body 71, a second angle adapter 72, and a label compartment 73. The holder body 71 provides an open-topped device made using flexible plastic and having a generally rectangular top opening and internal space sized so as to easily insert said wireless devices 150. The second angle adapter 72 is integral thereto the holder body portion 71 having similar construction and functionality as the aforementioned first angle adapter 63. The label compartment 73 comprises a cup shaped protrusion therefrom a side surface of the holder body 71 being integrally molded therein and sized so as to contain a roll of common barcode label stock. The magnetic probe assembly 80 comprises a small cylinder-shaped magnet 81 permanently affixed thereto a magnetic probe adapter 82 using adhesives or molding processes. The magnetic probe assembly 80 provides a testing means thereto magnetic and/or reed-type smoke detector switches via magnetic activation thereof. The mechanical probe assembly 90 is envisioned to be of a similar construction as the magnetic probe assembly 80 and comprises a mechanical probe portion 91 and a probe adapter 92 forming a one-piece plastic molded part. The mechanical probe portion 91 comprises an approximately two (2) inch long protrusion approximately one-half (½) of an inch in diameter and providing a mechanical activation means thereto smoke detectors 130 having button-type activation switches. The attachment case 140 provides compact and protective storage of said attachments 60, 70, 80, 90 and comprises a case body 141, a plurality of attachment cavities 142, internal fill/padding 143, a case handle 144, a case hasp 145, and a pair of hinges 146. The attachment case 140 comprises a conventional rectangular sheet metal utility box comprising a case body 141 and shallow top lid 147. The case body 141 is approximately four (4) inches deep and eighteen (18) inches on each side edge. The case lid 147 is approximately one (1) inch deep and comprises particular inner rectangular dimensions so as to fit snuggly over a mating perimeter edge of the case body 141 in an expected manner. The case body 141 and case lid 147 are made using painted or plated sheet metal and fabricated using conventional sheet metal fabrication processes. The case body 141 and case lid 147 further provide conventional expected features such as a grasping case handle 144, a latching case lid hasp 145, and a pair of common metal axle hinges 146 being spaced and riveted thereto along a joining edge. Said case body 141 and case lid 147 further provide protection thereto included attachments 60, 70, 80, 90 via an internal fill/padding portion 143 made preferably using urethane foam and being affixed thereto said case body 141 and case lid 147 using common adhesives. The fill/padding 143 comprises a plurality of attachment cavities 142 comprising a specific profile and depth so as to emulate particular attachments 60, 70, 80, 90, thereby providing a snug padded fit thereto when inserted therein. The attachment case 140 is depicted here containing the previously described attachments 60, 70, 80, 90; however, it is understood that the apparatus 10 is not limited thereto the aforementioned attachments 60, 70, 80, 90 but may be purchased therewith additional attachments associated with other types, makes, and models of smoke detectors and as such should not be interpreted as a limiting factor of the invention 10. Furthermore, it is understood that the apparatus 10 may be purchased with no attachments at all or purchased therewith any combination of attachments based upon specific smoke detector 130 testing tasks to be performed.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of assembling the apparatus 10 may be achieved by performing the following steps: procuring an apparatus 10, a correct number of extension tubes 30, and appropriate attachments 60, 70, 80, 90 based upon anticipated smoke detector testing tasks and ceiling heights which may be encountered; loading an aerosol smoke container 120 thereinto the smoke container fixture 42; adjusting the vertical position of the aerosol smoke container 120 therein the smoke container fixture 42 by adjusting the threaded actuator 45 up or down to produce the desired smoke gas flow 110 therethrough the first gas tube 20; loading an aerosol air container 125 thereinto the air container fixture 52; carefully positioning the nozzle portion of the aerosol air container 125 thereinto the first gas tube orifice 23; removing an application-specific attachment 60, 70, 80, 90, if required, therefrom the attachment case 140, based upon a particular smoke detector testing task, installing said attachment 60, 70, 80, 90 by insertion of the second gas tube 21 thereinto.

The method of utilizing the apparatus 10 to test a variety of smoke detectors 130 may be achieved by performing the following steps: testing a smoke detector device 130 by loosening the adjustment knob 22 portion of the first gas tube 20; extending said second gas tube 21 outwardly to a needed length; tightening the adjustment knob 22, thereby securing the second gas tube 21 in position; adding a desired number of extension tubes 30 by inserting a tubular end portion therein the straight female adapter 31, as required by a particular detector 130 testing task; manually pressing the trigger portion 44 of the smoke dispenser assembly 40 to propel a smoke gas flow 110 therefrom the aerosol smoke container 120 therethrough the first 20 and second 21 gas tubes and any attached extension tubes 30; engulfing said smoke detector 130 therein a smoke gas flow 110 causing activation of the detector 130; restoring the smoke detector 130 by subsequently pressing a valve portion of the aerosol air container 125, thereby propelling an air gas flow 115 therethrough the apparatus 10, thereby purging smoke therefrom the smoke detector 130 to deactivate and complete the test; removing a spent smoke container 120 by pressing down on the spring portion 48 thereby angular release of the smoke container nozzle 120 therefrom the first gas tube 20 and subsequently from the smoke container fixture 42.

The method of utilizing the test enclosure assembly portion 60 of the apparatus 10 to test a smoke detector 130 may be achieved by performing the following steps: removing the test enclosure assembly portion 60 therefrom the attachment case 140; adding a required number of extension tubes 30, as required to reach a detector 130 by pressing the straight female adapter portion 31 over the distal end portion of the second gas tube 21; adjusting the second gas tube 21 length as needed to achieve a correct total length of the apparatus 10 required to reaching a target smoke detector 130; mounting the test enclosure assembly 60 thereto the apparatus 10 by pressing the first angle adapter portion 63 onto the distal end portion of the extension tube 30 via a friction fit thereupon; raising the apparatus 10 upwardly toward a ceiling or wall surface by holding the two (2) handgrips 43 with each hand; positioning the enclosure body portion 61 of the test enclosure assembly 60 over said smoke detector 130 so as to encapsulate said detector 130; sequentially applying the smoke 110 and air 115 gas flows thereto the detector 130 as previously described to conduct a test; returning the test enclosure assembly portion 60 thereto the attachment case 140 when finished with said testing task.

The method of utilizing the remaining attachments of the apparatus 10 to test a smoke detector 130 may be achieved by performing the following steps: attaching the wireless device holder assembly 70 thereto the extension tube portion 30 in a similar manner as the aforementioned test enclosure assembly 60; performing necessary wireless related tests and data logging using various devices 150 such as barcode scanners and the like; removing barcode labels as needed therefrom the label compartment portion 73 as needed; or attaching the magnetic probe assembly 80 thereto the extension tube portion 30 as previously described; performing various tests on magnetic switch portions of a smoke detector 130 using the magnet 81; or attaching the mechanical probe assembly 90 thereto said extension tube 30 in like manner; activating one (1) or more button-activated smoke detectors 130 as required, by contacting said switch button portion of the smoke detector 130 using the probe 91.

Compact and protective storage of all attachments 60, 70, 80, 90 is accomplished by insertion therewithin the attachment cavity portions 142 of the attachment case 140; closing the lid 147; and securing said lid 147 thereto the case body 141 by latching the hasp fixture 145.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A smoke detector testing apparatus, comprising:

a smoke dispenser assembly, comprising:

a smoke container holding an amount of smoke;

a smoke handle having a smoke handgrip providing a first means to hold said apparatus;

a smoke container fixture connected to said smoke handle providing a smoke mounting means to said smoke container; and, a smoke trigger for dispensing said amount of smoke from said smoke container;

a means for holding an amount of air; and, a means for dispensing said amount of air.

2. The apparatus of claim 1, wherein said amount of smoke is dispensed for testing a smoke detector and said amount of air is dispensed for purging said amount of smoke therefrom said smoke detector.

3. The apparatus of claim 1, wherein said means for holding said amount of air and said means for dispensing said amount of air comprises an air holding assembly.

4. The apparatus of claim 3, wherein said air holding assembly comprises:

an air container holding said amount of air;

an air handle having an air handgrip providing a second means to hold said apparatus;

an air container fixture connected thereto said air handle providing an air mounting means thereto said air container; and, an air trigger for dispensing said amount of air therefrom said air container.

5. The apparatus of claim 4, wherein said apparatus further comprises a conveying tube, said conveying tube further comprising:

a first tube having a proximal end and a distal end, said first tube mechanically connected thereto said air container at said proximal end and mechanically connected thereto said smoke container at a portion between said proximal end and said distal end;

wherein said amount of smoke dispensed therefrom said smoke container travels therethrough said first tube thereout said distal end; and, wherein said amount of air dispensed therefrom said air container travels therethrough said first tube thereout said distal end.

6. The apparatus of claim 5, wherein said air handle is attached perpendicularly downward therefrom a bottom surface of said proximal end of said first tube and said smoke handle is attached perpendicularly downward therefrom said bottom surface of said first tube parallel to said air handle.

7. The apparatus of claim 5, wherein said conveying tube further comprises a second tube telescopically connected therewith said first tube, wherein said second tube provides a first length extension means thereto said conveying tube.

8. The apparatus of claim 7, wherein said first tube further comprises an adjustment means for securing said second tube thereto said first tube at a desired position.

9. The apparatus of claim 7, wherein said first tube further comprises a means for removably attaching an extension tube along an upper surface of said first tube, wherein said extension tube is removably attachable thereto an end of said second tube, thereby providing a second length extension means thereto said conveying tube.

10. The apparatus of claim 9, wherein said means for removably attaching said extension tube along said upper surface of said first tube comprises a pair of clamp brackets.

11. The apparatus of claim 5, wherein said apparatus further comprises a test enclosure assembly removably attachable thereto an end of said conveying tube, thereby providing a means to conserve a volume of said amount of smoke dispensed during a smoke detector test.

12. The apparatus of claim 5, wherein said apparatus further comprises a wireless device enclosure assembly removably attachable thereto an end of said conveying tube, thereby providing a wireless device holding means for a variety of electronic equipment.

13. The apparatus of claim 5, wherein said apparatus further comprises a magnetic probe assembly removably attachable thereto an end of said conveying tube, thereby providing a magnetic testing means for a magnetic-type smoke detector.

14. The apparatus of claim 5, wherein said apparatus further comprises a mechanical probe assembly removably attachable thereto an end of said conveying tube, thereby providing a mechanical activation means thereto a smoke detector having a button-type activation.

15. A smoke detector testing apparatus, comprising:

a smoke dispenser assembly for holding an amount of smoke and for dispensing said amount of smoke, comprising:

a smoke container holding said amount of smoke;

a smoke handle having a smoke handgrip providing a first means to hold said apparatus;

a smoke container fixture connected thereto said smoke handle providing a smoke mounting means thereto said smoke container; and, a smoke trigger for dispensing said amount of smoke therefrom said smoke container;

an air holding assembly for holding an amount of air and for dispensing said amount of air, comprising:

an air container holding said amount of air;

an air handle having an air handgrip providing a second means to hold said apparatus;

an air container fixture connected thereto said air handle providing an air mounting means thereto said air container; and, an air trigger for dispensing said amount of air therefrom said air container;

a conveying tube, further comprising:

a first tube having a proximal end and a distal end, said first tube mechanically connected thereto said air container at said proximal end and mechanically connected thereto said smoke container at a portion between said proximal end and said distal end;

wherein said amount of smoke dispensed therefrom said smoke container travels therethrough said first tube thereout said distal end;

wherein said amount of air dispensed therefrom said air container travels therethrough said first tube thereout said distal end; and, wherein said amount of smoke is dispensed for testing a smoke detector and said amount of air is dispensed for purging said amount of smoke therefrom said smoke detector.

16. The apparatus of claim 15, wherein said apparatus further comprises:

a carrying case having a plurality of storage compartments;

wherein said carrying case provides a means to transport said apparatus; and, wherein said plurality of storage compartments provide a means to store said apparatus.

17. A method for assembling and utilizing a smoke detector testing apparatus, said method comprising the steps of:

providing said apparatus, comprising:

a smoke dispenser assembly for holding an amount of smoke and for dispensing said amount of smoke, comprising:

a smoke container holding said amount of smoke;

a smoke handle having a smoke handgrip providing a first means to hold said apparatus;

a smoke container fixture connected thereto said smoke handle providing a smoke mounting means thereto said smoke container; and, a smoke trigger for dispensing said amount of smoke therefrom said smoke container;

an air holding assembly for holding an amount of air and for dispensing said amount of air, comprising:

an air container holding said amount of air;

an air handle having an air handgrip providing a second means to hold said apparatus;

an air container fixture connected thereto said air handle providing an air mounting means thereto said air container; and, an air trigger for dispensing said amount of air therefrom said air container;

a conveying tube, further comprising:

a first tube having a proximal end and a distal end, said first tube mechanically connected thereto said air container at said proximal end and mechanically connected thereto said smoke container at a portion between said proximal end and said distal end;

wherein said amount of smoke dispensed therefrom said smoke container travels therethrough said first tube thereout said distal end;

wherein said amount of air dispensed therefrom said air container travels therethrough said first tube thereout said distal end; and, wherein said amount of smoke is dispensed for testing a smoke detector and said amount of air is dispensed for purging said amount of smoke therefrom said smoke detector;

loading said smoke container thereinto said smoke container fixture;

adjusting a vertical position of said smoke container therein said smoke container fixture by adjusting a threaded actuator up or down to produce a desired smoke gas flow therethrough said first tube;

loading said air container thereinto said air container fixture; and, carefully positioning a nozzle portion of said air container thereinto a first tube orifice.

18. The method of claim 17, further comprising the steps of:

loosening an adjustment knob of said first tube;

extending said second tube outwardly to a desired length;

tightening said adjustment knob, thereby securing said second tube in position;

adding a desired number of extension tubes by inserting a tubular end portion therein a straight female adapter, as required by a particular detector testing task;

manually pressing said smoke trigger to propel a smoke gas flow therefrom said smoke container therethrough said first tube and said second tube and any attached extension tubes;

engulfing said smoke detector therein said smoke gas flow causing activation of said smoke detector;

restoring said smoke detector by subsequently pressing said air trigger of said air container, thereby propelling an air gas flow therethrough said apparatus, thereby purging smoke therefrom said smoke detector to deactivate and complete the test; and, removing a spent smoke container by pressing down on a spring portion thereby angular release of a smoke container nozzle therefrom said first tube and subsequently from said smoke container fixture.

19. The method of claim 18, further comprising the step of installing a test enclosure assembly by removably attaching thereto an end of said conveying tube.

20. The method of claim 18, further comprising the step of installing a wireless device enclosure assembly by removably attaching thereto an end of said conveying tube.

21. The method of claim 18, further comprising the step of installing a magnetic probe assembly by removably attaching thereto an end of said conveying tube.

22. The method of claim 18, further comprising the step of installing a mechanical probe assembly by removably attaching thereto an end of said conveying tube.

* * * * *